United States Patent [19]

Federighi

[11] Patent Number: 4,512,475

[45] Date of Patent: Apr. 23, 1985

[54] SINGLE OR MULTIPLE DOSE CONTAINER-CLOSURE ASSEMBLIES

[76] Inventor: Alberto Federighi, Casella Postale Via Carmignani 37, 56100 Pisa, Italy

[21] Appl. No.: 548,613

[22] Filed: Nov. 4, 1983

[51] Int. Cl.[3] ..... B65D 1/08; B65D 17/24; B67D 5/56; B65D 85/62

[52] U.S. Cl. ..... 206/484; 206/820; 215/32; 222/541; 222/456

[58] Field of Search ..... 206/484, 820; 222/541, 222/456; 215/32

[56] References Cited

U.S. PATENT DOCUMENTS 3,858,739 1/1975 Turner et al. ..... 222/541

3,917,120 11/1975 Larenz et al. ..... 206/484

*Primary Examiner*—William T. Dixson, Jr.

*Attorney, Agent, or Firm*—Eugene E. Renz, Jr.

[57] ABSTRACT

A series of container-closure assemblies, for liquid products characterized by a container consisting of a tubular hollow body portion having a lower side opening which can be sealed by welding and an upper neck closed at the upper side by a stalk and a stopper integrally connected to the discharge end of the container by a stalk provided with means to close the neck of the container after the opening by means of fracturing the stalk, the lateral sidewalls of the container body portion and stopper of each assembly in the series connected by fins and a fracturable scoreline to facilitate separation of each container-closure assembly of the series.

5 Claims, 5 Drawing Figures

SINGLE OR MULTIPLE DOSE CONTAINER-CLOSURE ASSEMBLIES

BACKGROUND OF THE INVENTION

1. Field of the Invention

The present invention relates to containers for pharmaceutical products or the like. The invention relates particularly to so-called "mini-containers" of a relatively small size for a quantity of a liquid product, for example, a pharmaceutical product suitable for a single application dose.

2. Description of the Prior Art

Mini-containers or single dose packages are generally known and a typical version is illustrated in Turner et al U.S. Pat. No. 3,858,739. These packages are usually made of a plastic material and in some instances these containers are made in strips of five or six joined in a continuous manner along one side or verticle edge by means of connecting stalks or welded points. In these prior assemblies, the junction sections between each container are such that the separation requires a few rotations of the container around the reciprocal connecting axis.

SUMMARY OF THE INVENTION

It is an object of the present invention to provide an improved container-closure assembly which is characterized by novel features of contruction and arrangement providing certain advantages in the manufacture and use as compared to those presently on the market. In accordance with the present invention, there is provided a series of container-closure assemblies comprising wherein the container and stopper of each assembly is provided with diametrically opposed fins or webs which are integrally connected by a bridge or tear section of reduced cross section and which constitute connecting means for a series of the container-closure assemblies in a side-by-side relation. The connecting webs facilitates handling of the container and stopper and removal of the stopper when the container has been detached from the strip and thus these webs are also present on the external side of the first and container-closure in the strip. The webs also enhance the aesthetics of the assembly.

In summary, therefore, the present invention provides a single or multiple dose container-closure assembly for pharmaceutical products which is adapted to be molded from plastic material wherein the container includes a body portion of generally conical shape in plan view and generally oval shaped laterally, the lower end of the body being open to facilitate filling the containers with a pharmaceutical product. The open bottom end is adapted to be sealed by welding once filled. The body portion of the container terminates in reduced neck portion normally sealed by a stalk-like connecting piece formed integrally with stoppers in an inverted position, which stalk after removal of the stopper exposes a discharge opening in the neck of the container. The lateral sidewalls of the body portion and the stopper are formed with diametrically opposed laterally extending webs or fins which are interconnected along fracturable scorelines to provide an assembly of interconnected container-closure assemblies which may be easily separated from one another when desired.

BRIEF DESCRIPTION OF THE DRAWINGS

These and other objects of the present invention and the various features and details of the operation and construction thereof are hereinafter more fully set forth with reference to the accompanying drawings, wherein.

DESCRIPTION OF THE PREFERRED EMBODIMENT

Figure 2:
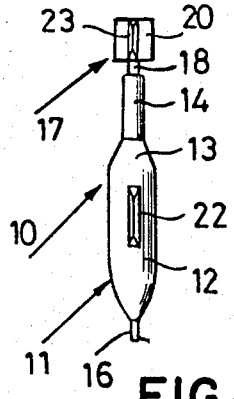
FIG. 2 is a side elevational view of a container-closure assembly showing the bottom end open to facilitate filling of a product.
Figure 1:
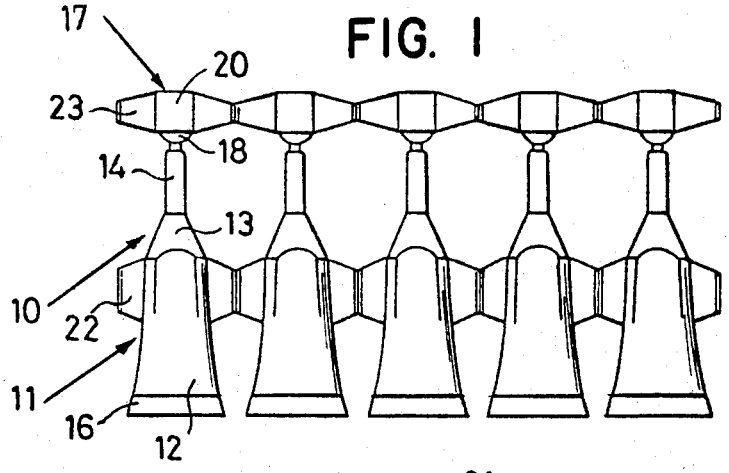
FIG. 1 is a side elevational view of a strip of interconnected container-closure assemblies in accordance with the present invention.
Figure 3:
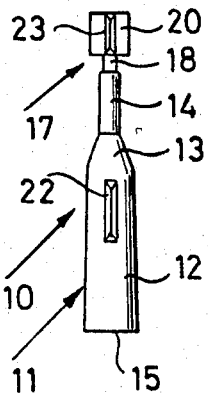
FIG. 3 is a side elevational view similar to FIG. 2 after filling showing the bottom end of the container sealed.
Figure 3:
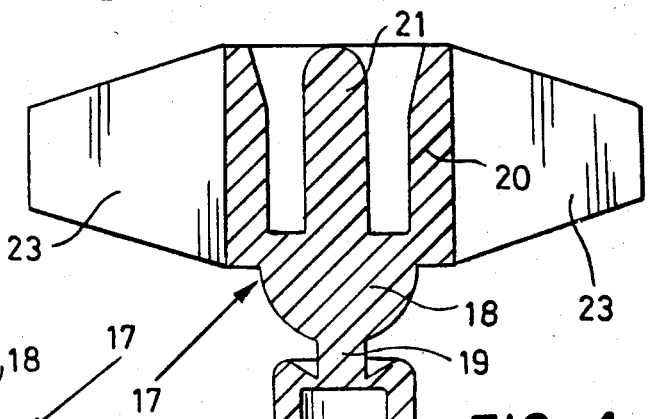
Figure 4:
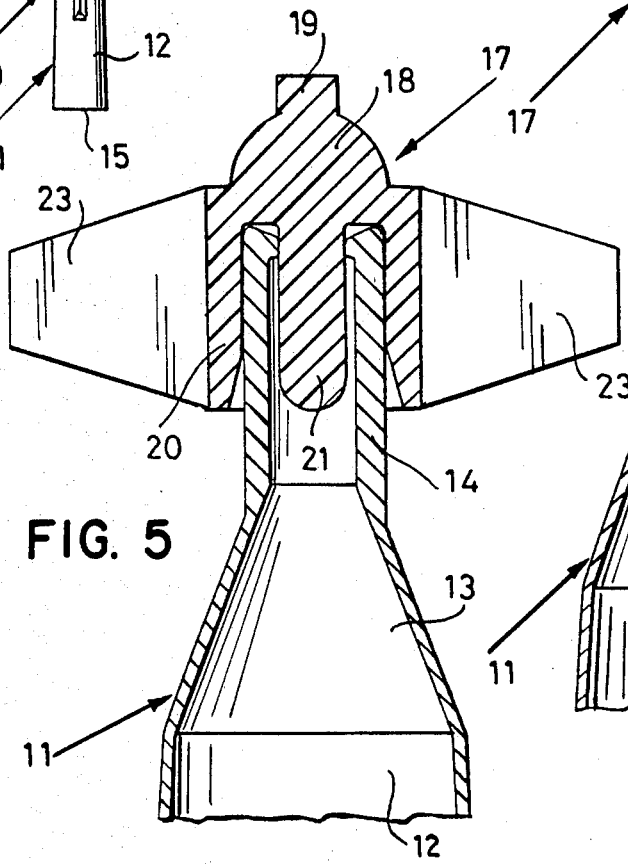
FIGS. 4 is an enlarged transverse fragmentary sectional view showing the upper portion of the container and the stopper in a normally sealed condition.

Referring now to the drawings and particularly to FIGS. 1, 2, and 3 thereof, each container-closure assembly is generally designated by the numeral 10 and comprise an elongated tubular body portion 11 having a tapered section 13 terminating at its upper end in a generally cylindrical neck portion 14. As illustrated in FIG. 2, the lower end of the body portion is initially open to facilitate filling of a product, such as a pharmaceutical product and after filling is adapt to be sealed by application of heat and pressure to provide a welded seam 16. (See FIGS. 1 and 3)

Figure 5:
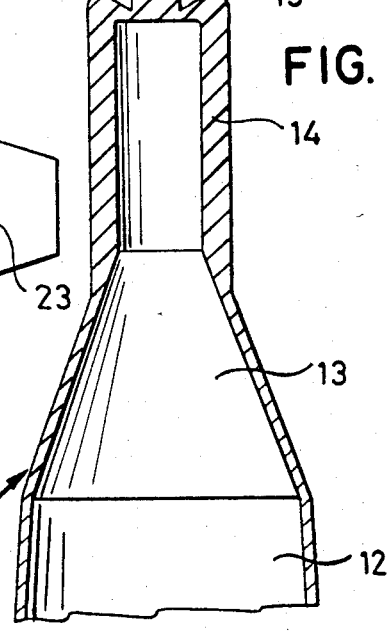
FIG. 5 is a transverse sectional view similar to FIG. 4 showing the stopper removed and inverted for recapping or sealing the opening in the neck of the container.

The assembly also includes a stopper 17 having a central body portion 18 provided with a pin like projection or stalk 19 formed integrally with the outer terminal end of the neck 14 of the container and normally closing the open end thereof. The body portion 18 has a generally cylindrical skirt portion 20 and a central elongated tang 21 which is aligned axially with the pin or stalk 19. The stopper 17 may be readily removed from the neck 14 of the container 10 by a pivoting action when it is desired to discharge the contents of the container. If less than all of the contents are used and it is desired to store the remainder, the stopper 17 is simply inverted and the tang 21 is pressed into the opening of the container as illustrated in FIG. 5. Note that the inner peripheral edge of the skirt 20 is tapered outwardly as at 20*a* to serve as a pilot facilitating assembly of the stopper to the container for reclosing purposes.

In accordance with the present invention, a series of interconnected container-closure assemblies is provided which is relatively easy and economical to manufacture and wherein the assemblies are connected by the closure and body portion of the container in a manner so that they are easily separatable from one another. To this end the body portion 12 of each of the containers is provided with diametrically opposed webs or fins 23 which are of trapezoidal configuration and are disposed adjacent to and just below the conical juncture 13 connecting the body portion 12 to the neck 14 of the container and the stopper or closure 17 is also provided with a diametrically opposed generally trapezoidal connecting webs or fins 23. The outer terminal edge of each of the connecting webs or fins are tapered or necked down to define a relatively thin connecting bridge or fracturable score line 25 and 26 between the adjacent containers and stoppers of each assembly. It is noted that the container-closure assemblies and fins are preferably made from a plastic such as polypropylene which is advantageous since it permits sterilization with steam before filling the containers. They may also be sterilized after filling.

Considering the use of the strip of container-closure assemblies, the container-closure units are easily separatable from the strip simply by supporting the strip in one hand and with other hand exerting a back and forth bending action along the endmost unit which causes a weakening and separation at the fracturable bridge connections 25 and 26. Thereafter the user simply supports the container between two fingers and produces a bending of the stopper 17 relative to the axis of the pin or stalk 19 utilizing the webs 23 as gripping means to sever the stalk 19 from neck 14 of the container. The product may then be discharged from the container by a simple squeezing action of the blister shaped body portion of the container. If less than the entire contents are used and it is desired to reclose the container for purposes of storing and preserving the remainder of the product, the stopper 17 is simply reversed to align the tang 21 with the opening in the container and then pressed into the container to the position shown in FIG. 5.

In summary, therefore, the present invention provides a novel assembly of container-closures integrally connected by webs or fins in the manner described above which may be manufactured easily and economically and separation of one of the container-closure units at a time from the strip is accomplished in a relatively simple fashion. The webs or fins in addition to adding estatically also serve as gripping means for removing each container-closure unit. The fins or webs also allow the formation of a droplet when the product of the container is applied and the webs or fins of the stopper aid in tightly closing the assembly after a first incomplete application of the product.

What is claimed is:

1. A series of injection molded container-closure assemblies, for liquid products characterized by a container consisting of a tubular hollow body portion having a lower side opening which can be sealed by welding and an upper neck closed at the upper side by a stalk and a stopper integrally connected to the discharge end of the container by a stalk provided with means to close the neck of the container after the opening by means of fracturing the stalk, the lateral sidewalls of the container body portion and stopper of each assembly in the series being joined by separate connecting fins, said fins of adjacent assemblies being connected along a fracturable scoreline to facilitate separation of each container-closure of the series.

2. Container-closure according to claim 1 characterized by the fact that the neck is cylindrical and the stopper has a central body from which the stalk protrudes from one side and an axial tang extending diametrically opposite to it relative to a cylindrical appendix of the body which forms a crown around the stalk, the fins protruding outside of said appendix, the stalk being such that it can be inserted with a tolerance in the hole of the neck which is opened after that the stopper has been removed by fracturing and the cylindrical appendix being such that it can be inserted with a tolerance around the neck during said insertion of the stalk in the discharge opening in the neck.

3. Container-closure according to claim 1 wherein said fins have essentially a trapezoidal shape.

4. Container-closure according to claim 1 wherein the extremities of the fins of the container body and the stopper from a joining element of the adjacent assemblies.

5. Container-closure according to claim 1 wherein assemblies are made of polypropylene.

* * * * *